US008607523B2

(12) United States Patent
Lee et al.

(10) Patent No.: US 8,607,523 B2
(45) Date of Patent: Dec. 17, 2013

(54) BUILDING THAT USES COMPOSITE LIGHT-WEIGHT PANELS FOR STRUCTURE AND A CONSTRUCTION METHOD THEREFOR

(76) Inventors: Byung Hwa Lee, Gyeongsangnam-do (KR); Kyung Hoon Kim, Daegu (KR)

( * ) Notice: Subject to any disclaimer, the term of this patent is extended or adjusted under 35 U.S.C. 154(b) by 465 days.

(21) Appl. No.: 12/937,518

(22) PCT Filed: Apr. 23, 2009

(86) PCT No.: PCT/KR2009/002139
§ 371 (c)(1),
(2), (4) Date: Oct. 12, 2010

(87) PCT Pub. No.: WO2009/131398
PCT Pub. Date: Oct. 29, 2009

(65) Prior Publication Data

US 2011/0036048 A1 Feb. 17, 2011

(30) Foreign Application Priority Data

Apr. 23, 2008 (KR) ..... 10-2008-0037600

(51) Int. Cl.
*E04B 1/02* (2006.01)
*E04B 1/35* (2006.01)

(52) U.S. Cl.
USPC ..... 52/656.1; 52/745.2

(58) Field of Classification Search
USPC ..... 52/309.11, 745.2, 745.06, 745.1, 794.1
See application file for complete search history.

(56) References Cited

U.S. PATENT DOCUMENTS

| | | | | | |
|---|---|---|---|---|---|
| 1,418,510 | A | * | 6/1922 | Alexander | 52/745.2 |
| 1,976,967 | A | * | 10/1934 | Scullin | 52/236.3 |
| 2,155,709 | A | * | 4/1939 | Patterson | 52/262 |
| 2,604,060 | A | * | 7/1952 | Hansen | 52/643 |
| 4,628,650 | A | * | 12/1986 | Parker | 52/265 |
| 4,674,253 | A | * | 6/1987 | Young | 52/404.2 |

(Continued)

FOREIGN PATENT DOCUMENTS

| | | | | |
|---|---|---|---|---|
| EP | 1573142 B1 | | 7/2006 | |
| GB | 2028905 A | * | 3/1980 | E04B 1/35 |

(Continued)

OTHER PUBLICATIONS

International Search Report of International Application PCT/KR2009/002139 mailed Dec. 14, 2009.

*Primary Examiner* — Christine T Cajilig
(74) *Attorney, Agent, or Firm* — Novick, Kim & Lee, PLLC; Jae Youn Kim

(57) ABSTRACT

The present invention relates to a building that uses composite light-weight panels for structure and a construction method therefor, more particularly, to a building constructed without pillars using composite light weight panels for structure and a construction method therefor, wherein the building comprises: a steel floor made out of sectional steel for example; walls which are formed by joining composite light-weight panels for structure having steel structure frames installed at corners to the steel floor by welding or joining means, neighboring steel structure frames being joined together by welding or joining means to form walls; roof frames which are constituted by a steel structure and have a truss structure to be positioned on the top of the walls and joined to the wall panels by welding or joining means; wall inner/outer coverings applied to the inner/outer peripherals of the walls; and roof coverings applied to the outer peripheral face of the roof frame.

15 Claims, 10 Drawing Sheets

(56) References Cited

U.S. PATENT DOCUMENTS

| | | | | |
|---|---|---|---|---|
| 4,936,069 | A | 6/1990 | Hunter et al. | |
| 5,722,198 | A * | 3/1998 | Bader | 52/745.09 |
| 6,067,771 | A * | 5/2000 | Blankenship | 52/745.2 |
| 6,282,853 | B1 * | 9/2001 | Blaney et al. | 52/223.7 |
| 8,176,696 | B2 * | 5/2012 | LeBlang | 52/309.12 |
| 2003/0188495 | A1 * | 10/2003 | Taylor et al. | 52/93.1 |
| 2005/0204697 | A1 | 9/2005 | Rue | |
| 2006/0037273 | A1 | 2/2006 | Hashimoto et al. | |
| 2006/0117689 | A1 | 6/2006 | Onken et al. | |
| 2009/0232623 | A1 * | 9/2009 | Munro et al. | 414/10 |

FOREIGN PATENT DOCUMENTS

| | | | |
|---|---|---|---|
| JP | 04-027049 | A | 1/1992 |
| JP | 06-129020 | A | 5/1994 |
| JP | 08-184101 | A | 7/1996 |

* cited by examiner

BUILDING THAT USES COMPOSITE LIGHT-WEIGHT PANELS FOR STRUCTURE AND A CONSTRUCTION METHOD THEREFOR

TECHNICAL FIELD

The present invention relates to a building using structural composite light-weight panels and a construction method thereof, and more particularly, to a building using structural composite light-weight panels in which structural composite light-weight panels having steel structure frames with a sufficient rigidity installed at edges thereof serve as a structure so that a building can be constructed even without installing pillars, thereby facilitating construction of the building and reducing the construction period and cost, so that the roof can be installed on the wall in a prefabricated state, thereby facilitating on-site construction and securing stability of construction, and so that the structural composite light-weight panels are used, thereby decreasing the construction cost and providing excellent heat resistance and fire resistance, and a construction method thereof.

BACKGROUND ART

A composite light-weight panel is used for heat insulation of a structure of all the buildings including stores, factories, town houses, single family houses, etc., as well as roofs and slabs, interior/exterior wall partitions and side walls of a building requiring separate heat insulation. In particular, the composite light-weight panel is used further advantageously upon of new extension and reconstruction of a building an existing building due to its lightweightness.

As an example of such a composite light-weight panel, a wire panel uses, as a structure, a mesh in which a galvanized steel wire is formed in a mesh shape. The wire panel includes a heat insulating material such as polystyrene foam (Styrofoam) embedded at the center thereof. Also, since the wire panel is excellent in heat resistance, soundproof, moistureproof, sound insulation and earthquake resistance capacity, its construction is further facilitated as compared to other construction materials, thereby saving the construction cost and cutting down the construction period. Thus, the composite light-weight panel is a very economic construction material.

The order of construction of a structure using such a wire panel will be described hereinafter.

A reinforcing bar or a fixing ironwork acting as a pillar is installed on a foundation concrete floor or a slab floor, and then panels are erected and the fixed portions of the panels are tightly joined to the reinforcing bar or the fixing ironwork by tightening wires. Thereafter, the concrete surface and the panels as well as neighboring panels are joined to a reinforcing mesh by various kinds of ironworks.

Then, a door and a window, and a ventilation portion are cut from the composite light-weight panel. A door frame and a window frame are installed at the cut portions of the composite light-weight panel, and electric or various equipments/pipings are installed and embedded in necessary portions. The equipments/pipings at the embedded positions are reinforced by reinforcing meshes.

In case where a structure is constructed using this wire panel, since the meshes are protruded externally, mortar is sprayed onto the meshes or the meshes are covered by plastering in order to coveringly finish the meshes. An existing covering such as a plaster board or the like encounters a problem in that it cannot be directly applied to the meshes. In addition, in case of using mortar, since the time to cure the mortar surface is required, the work time is prolonged.

Further, a conventional container typically has a steel structure and is internally covered by a covering such as plywood attached with a heat insulating material and a wallpaper. The container involves a drawback in that since the container is formed of steel high in heat conductivity at the outer periphery thereof, it is hot during the summer and it is cold during the winter due to poor heat insulation.

In addition, after such a container is assembled in a factory and is moved to the scene of work. Then, the assembled container is installed on a foundation ground. The reason for this is that since the steel frames constituting the container are rigid, there is no risk of breakage of the assembled container even during the movement of the container. However, a sandwich panel mainly used for a conventional prefabricated house or the like has a problem in that since it uses a thin plated steel sheet, there is a risk of breakage such as bending or collapse of a structure during its movement.

In an attempt to address and solve these problems, as a prior application filed by the applicant of the present invention, Korean Patent Registration No. 10-0792243 has been issued and registered which discloses a composite light-weight panel including a heat insulating material, a pair of opposed meshes installed to both sides of the heat insulating material by means of pins 250 in such a fashion as to be spaced apart from each other by a predetermined distance, and interior and exterior covering structures disposed between the heat insulating material and the meshes and made of a material capable of fixing interior and exterior coverings.

In addition, as a prior application filed by the applicant of the present invention, Korean Utility Model Registration Application No. 20-2007-0014617 has been filed which discloses a structural composite light-weight panel including steel structure frames, a plurality of structural boards arranged within the steel structure frames, a heat insulating material disposed between the structural boards, and interior and exterior covering structures disposed at both sides of the heat insulating material and configured to fix a covering such as a plaster board.

In the meantime, in case of a steel house widely used as a conventional prefabricated house, structures of a house such as pillars and a roof are formed of section steel or the like after completion of a foundation work. Then, a heat insulating material is embedded in the steel and a board or the like is installed at both sides of the heat insulating material so that interior and exterior coverings can be applied to the board. Thereafter, the board or the like is covered by the interior and exterior coverings to complete the construction of a roof. However, such a conventional steel house construction method entails a problem in that it consists of a plurality of steps including installation of the steel structures for forming the wall, installation of the heat insulating material, installation of the board, resulting in an increase in labor cost and construction period.

In addition, the above sandwich panel is formed by stacking thin plated steel sheets on both sides of the Styrofoam layer. Since the sandwich panel is configured as an open structure in which four corners thereof are all opened, the Styrofoam is exposed to the outside. For this reason, Styrofoam and Styrofoam directly abut against each other at the connecting portions of the sandwich panel so that all the Styrofoam of the sandwich panel is burnt at high speed upon occurrence of a fire at an arbitrary position. Thus, the sandwich panel has a shortcoming in that it is vulnerable to a fire.

Further, the sandwich panel encounters a problem in that plated steel sheets are connected to each other so that a space is actually defined in two plated steel sheets so as to allow the heat insulating materials to be inserted thereto, in that since the heat insulating materials are connected to each other, vibration of sound and noise by the inner space is serious, and in that since a structural board such as an oriented strand board (OS) is also continuously installed on both sides of the heat insulating material in an existing wood or steel house, vibration of sound is easily transferred.

DISCLOSURE OF INVENTION

The present invention has been made in order to solve the above-mentioned problems associated with the conventional construction method using the wire panel and the conventional construction method of the steel container, the steel house and the sandwich panel, and it is an object of the present invention to provide a building using structural composite light-weight panels and a construction method thereof, in which buildings can be simply and easily constructed by using the structural composite light-weight panels, thereby achieving a sufficient rigidity while significantly reducing the construction period and cost.

To achieve the above objects, according to one aspect, the present invention provides a building constructed without pillars using structural composite light-weight panels, wherein the building includes: a steel floor made of section steel; a wall including a plurality of structural composite light-weight panels each having steel structure frames installed at edges thereof, the structural composite light-weight panels being joined to the steel floor by welding or joining means and neighboring steel structure frames of the panels being joined together by welding or joining means to form the wall; a plurality of roof frames composed of a steel structure and including a truss structure, the roof frames being positioned on the top of the wall so as to be joined to the structural composite light-weight panels of the wall by welding or joining means; wall interior and exterior coverings applied to the inner and outer peripheries of the wall; and a roof covering applied to the outer peripheral face of the roof frames.

In the building according to the present invention, a first embodiment of the structural composite light-weight panel includes rectangular steel structure frames, a heat insulating material disposed within the steel structure frames, and interior and exterior covering structures disposed at both sides of the heat insulating material and made of a material capable of fixing interior and exterior coverings. Also, a second embodiment of the structural composite light-weight panel includes a plurality of structural boards arranged vertically within the steel structure frames, a heat insulating material disposed between the structural boards, and interior and exterior covering structures disposed at both sides of the heat insulating material.

In addition, a third embodiment of the structural composite light-weight panel includes a heat insulating material, a pair of opposed meshes installed to both sides of the heat insulating material by means of pins in such a fashion as to be spaced apart from each other by a predetermined distance, and interior and exterior covering structures disposed between the heat insulating material and the meshes and made of a material capable of fixing interior and exterior coverings. A fourth embodiment of the structural composite light-weight panel includes rectangular steel structure frames, a structural board arranged vertically within the steel structure frames, a heat insulating material 220 disposed between the structural boards, and interior and exterior covering structures disposed at both sides of the heat insulating material so as to be oriented in parallel with the structural board. A fifth embodiment of the structural composite light-weight panel is superposedly disposed in plural numbers in a juxtaposition relationship such that the steel structure frames abutting against each other are joined to each other by welding or joining means.

Further, the steel structure frames are installed by any one selected from the following joining methods: a method in which neighboring steel structure frames are joined to each other by welding in a state in which the confronting surfaces thereof abut against each other using a section steel having a "⊏" shape in cross-section, a method in which neighboring steel structure frames include a concave portion and convex portion formed correspondingly therein so as to be engaged with each other in a concave and convex engagement relationship such that they are joined to each other by welding or joining means, and a method in which neighboring steel structure frames are joined to each other by welding or joining means in a state in which longitudinal end faces thereof are partially protruded correspondingly so that the partially protruded longitudinal end faces are positioned abutting against each other, and an additional reinforcing panel made of iron or wood is attached to one sides of the convex portions.

Moreover, the roof frames including a truss structure may be formed on the top of the wall by a worker after formation of the wall. Also, the roof frames composed of a steel structure may include a truss structure to be formed in a roof shape so that they can lifted by a crane in a state in which the roof covering is applied or not applied to the outer peripheral face of the roof frames. To this end, the roof frames may further include a ring-like fixing member.

In the above constitution, the structural board may employ iron plate, steel plate, plywood or the like. The interior and exterior covering structures may employ any material to which joining means for covering a covering material such as plywood, recyclable plywood, wood, waste wood, plastic or the like can be fixed.

In the meantime, to achieve the above objects, according to another aspect, the present invention provides a method of constructing a building using structural composite light-weight panels, the method including the steps of: a foundation work execution step; a steel floor construction step in which a floor shape of a building is formed on a ground where a foundation work is executed using a steel frame made of a section steel to form a steel floor; a wall construction step in which a wall is formed on the steel floor using the structural composite light-weight panel including a heat insulating material and interior and exterior covering structures and having steel structure frames installed at edges thereof, in such a fashion that the steel floor and steel structure frames constituting the wall as well as the steel structure frames of neighboring structural composite light-weight panels are joined to each other by welding or joining means; a roof construction step in which the prefabricated steel roof frames including a truss structure are joined to the wall by welding or joining means; and a finishing step in which the inner and outer peripheries of the wall and the roof face are covered by wall and roof coverings to complete the construction of a building. According to the building construction method, since a building can be constructed without performing a pillar installing work, the building construction is facilitated. Also, since the steel structure frames serve as a structure, they have a sufficient rigidity even without pillars. Further, since the roof can be installed on the wall in a prefabricated state, on-site construction is convenient.

Meanwhile, to achieve the above objects, according to yet another aspect, the present invention provides a method of constructing a building using structural composite light-weight panels, the method including the steps of: a foundation work execution step; a steel floor construction step in which a floor shape of a building is formed on a ground where a foundation work is executed using a steel frame made of a section steel to form a steel floor; a roof frame forming step in which the roof frames are formed on the steel floor to conform to the dimension of the steel floor; a wall structure formation step in which the thus formed roof frames are removed upwardly from the steel floor and the structural composite light-weight panel including a heat insulating material and interior and exterior covering structures and having steel structure frames installed at edges thereof is joined to the steel floor by welding or joining means to form a wall structure at corner portions of the steel floor and reinforcing positions for supporting the roof frames; a roof construction step in which the roof frames are joined to the top of the wall structure by welding or joining means; a wall construction step in which the roof frames are joined to the top of the wall structure, and other structural composite light-weight panels are installed between the structural composite light-weight panels installed in the wall structure forming step to construct the wall; and a finishing step in which the inner and outer peripheries of the wall and the roof face are covered by wall and roof coverings to complete the construction of a building.

EFFECT OF THE INVENTION

According to the present invention as constructed above, since the structural composite light-weight panels are used which is light-weight and has an excellent strength, a building can be constructed without pillars and neighboring panels are joined to each other by welding or joining means, thereby improving constructionability and saving the construction cost. Also, the roof can be installed on the wall in a prefabricated state, leading to a reduction in construction period.

Furthermore, since the strength of the structural composite light-weight panels is excellent, breakage of the assemblies does not occur in the course of completing the assembly of the panels and then moving the panels, thereby improving constructionability.

Moreover, since the interior and exterior covering structures capable of fixing the interior and exterior coverings are used, a variety of coverings such as plaster board, Hwang Toh (red clay) mortar and the like besides concrete can be used, thereby improving an outer appearance of the structure.

In addition, a dwelling house using an existing container entails a problem in that since the outer wall of the house are made of steel high in heat conductivity, heat resistance is decreased. On the contrary, the present invention has an advantageous effect in which since any coverings including plaster board can be used, heat resistance can be improved.

Furthermore, the present invention has an advantageous effect in that the structural composite light-weight panels have a structure which is closed at the top/bottom and the left/right by steel structure frames, so that even if one structural composite light-weight panel is fired, supply of oxygen is limited, thereby ensuring relative stability against a fire and preventing a fire from spreading to the neighboring structural composite light-weight panels.

Besides, in the case where a non-flammable or fire-retardant material such as a plaster board, an external cement siding or the like is applied to the interior and exterior covering structures, a further securely closed structure is formed, thereby implementing reliable fire-resistance.

Further, as described above, the present invention has an advantageous effect in that the structural composite light-weight panels have a structure which is closed at the top/bottom and the left/right by steel structure frames, so that if the wall are tapped or are applied with an external impact (when a door is closed strongly), vibration generated from the wall is interrupted in the unit of a structural composite light-weight panel, thereby maximally reducing impact and noise.

In addition, since the steel floor, the wall and the roof frames are formed integrally with each other by a steel material, they have a strong resistance against earthquake and strong wind. Also, since the roof frames can be assembled on the steel floor, they can be maintained at an accurate horizontal and vertical position, thereby enabling accurate construction of a building. Since the roof frames can be formed on the steel floor, the number of high-altitude works is reduced, thereby securing stability of works.

Further, an existing steel house is constructed such that after execution of a foundation work, the following steps is performed sequentially: ① construction of steel frames (steel studs) are constructed, ② a heat insulating material is constructed, and ③ both sides of the heat insulating material and the steel frames are covered by a board. Thereafter, the interior and exterior coverings are applied. On the other hand, according to the present invention, since the structural composite light-weight panels are used by which the steps ①, ② and ③ are incorporated into a single step, a building can be easily assembled/constructed on-site, thereby significantly cutting down the construction period and the labor costs.

Also, the present invention has the following advantageous effects. After the prefabricated roof frames are lifted from the steel floor by a crane, the wall is simply assembled and joined and the roof frames are placed on the wall so as to be joined to the wall. Thus, in case of constructing a single-storied house (100 $m^2$), 1-3 hours are spent to assemble the wall after taking up a roof and place the roof on the wall. On the other hand, in case of constructing a single-storied house by using a conventional steel house, 5-10 days are typically spent to construct the wall and place the roof on the wall except the interior and exterior covering work after completion of installation of the steel floor. Thus, present invention greatly reduces the construction period.

EXPLANATION ON REFERENCE NUMERALS OF MAIN ELEMENTS OF THE DRAWINGS

Figure 1:
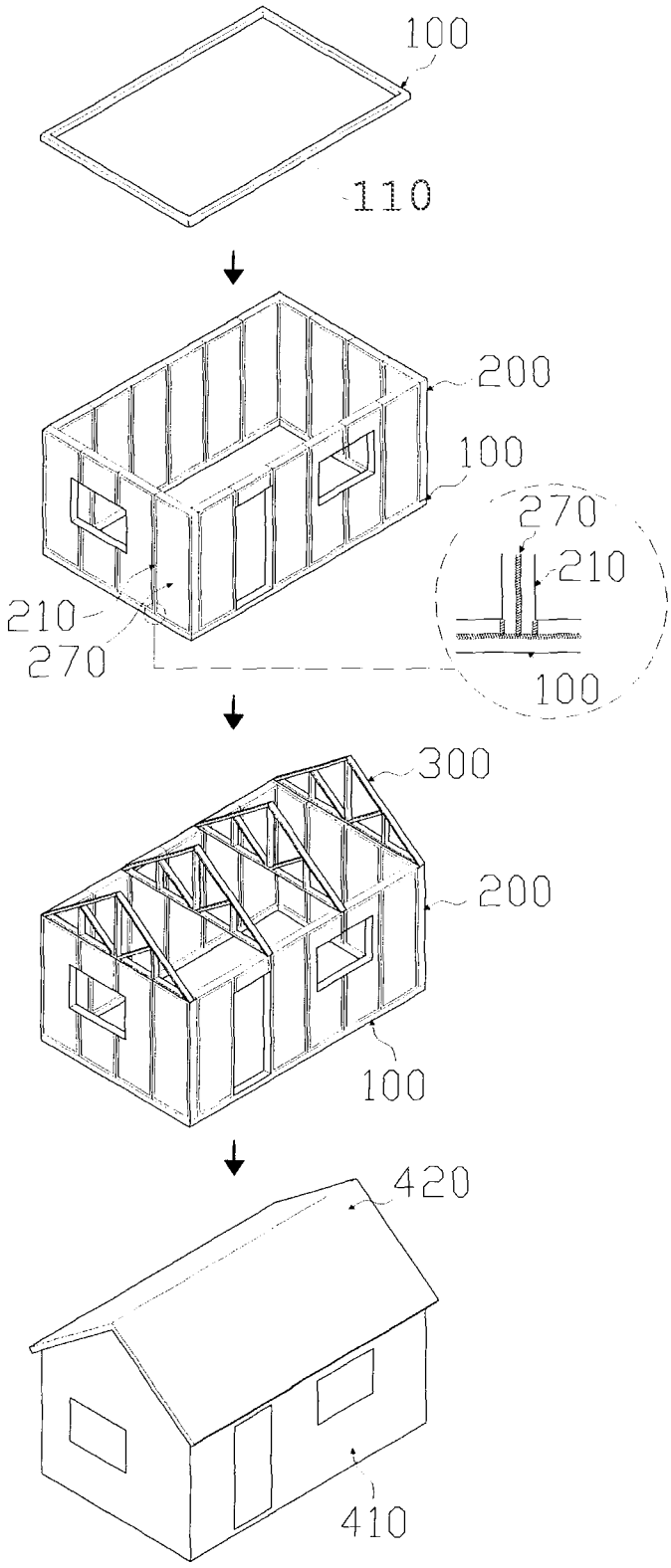
FIGS. 1 and 2 are process perspective views showing the constitution and construction process of a building using structural composite light-weight panels according to the present invention.

100: steel floor 200: wall
210: steel structure frames 270: panel
300: roof frames 410: wall interior and exterior coverings
420: roof covering

BEST MODE FOR CARRYING OUT THE INVENTION

Now, preferred embodiments of the present invention will be described hereinafter in more detail with reference to the accompanying drawings.

In the embodiments of the present invention, an example of a roof constituted by roof frames lifted by a crane or the like will be taken.

Figure 2:
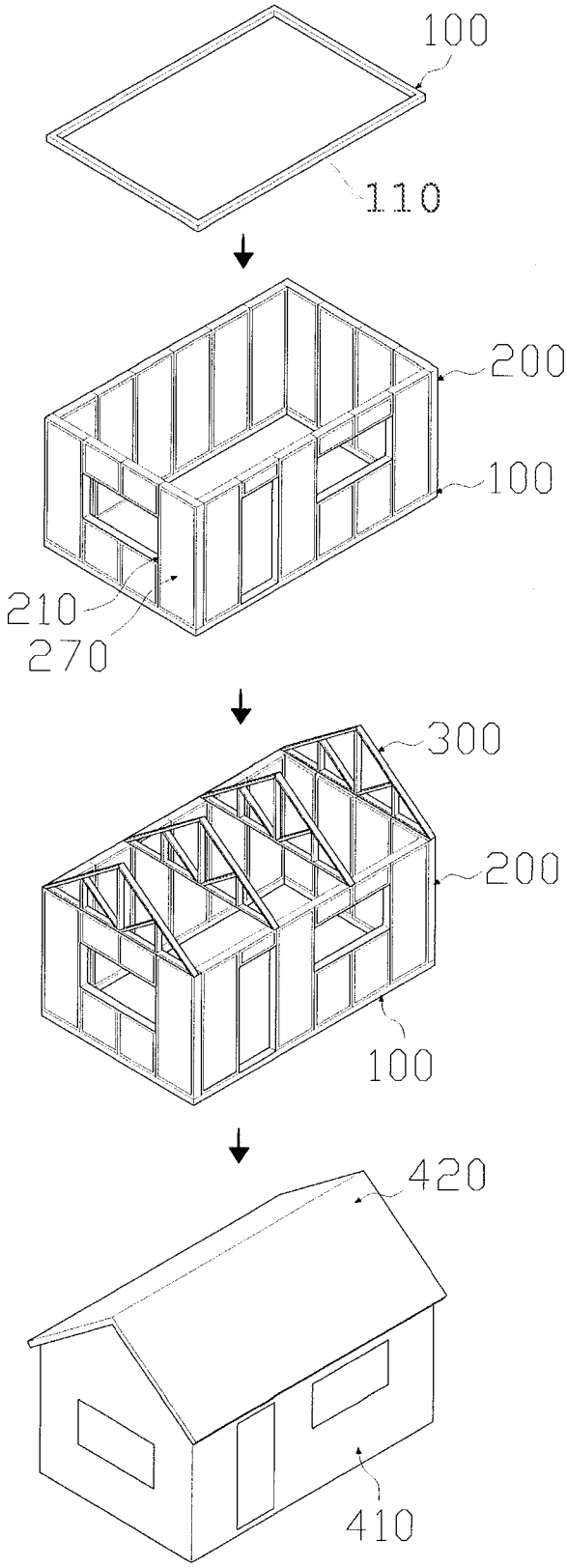

FIGS. 1 and 2 are process perspective views showing the constitution and construction process of a building using structural composite light-weight panels.

The constructions shown in FIGS. 1 and 2 are the same as each other except window frames and door frames.

Foundation Work Execution Step and Steel Floor Construction Step

First, in order to construct a building, after a foundation work is executed to flatten a ground, a steel floor 100 is constituted by section steels 110 depending on the shape of the building. In the steel floor 100, the section steels 110 are installed at positions where a wall 200 is formed. In case of a mobile home, a covering or finishing material such as a board or the like may be installed on the top of the section steels 110 in order to form a floor. In case of a non-mobile home, concrete may be directly cast on-site to conform to the height of the section steel 110 after the installation of pipings.

Wall Construction Step

A plurality of structural composite light-weight panels 270 each having steel structure frames 210 installed at edges thereof is disposed on the section steels constituting the steel floor 100. Then, the steel structure frames 210 and the steel floor 100 are joined to each other by welding or joining means (not shown) such as a bolt or the like. In FIG. 1, the steel structure frames 210 and the steel floor 100 are joined to one another by welding. Thereafter, the steel structure frames 210 of neighboring structural composite light-weight panels 270 are also joined to one another by welding or joining means such as a bolt or the like with them abutted against one another.

In this process, as shown in FIG. 1, the positions of a door and a window are adjusted such that the steel structure frames 210 are cut to conform to the dimension of a door frame and a window frame. Alternatively, as shown in FIG. 2, the structural composite light-weight panels 270 may be produced in such a fashion that the length and width of the steel structure frames 210 are be adjusted to conform to the dimension of the door frame and the window frame in the process of molding the steel structure frames 210. In case of the latter, an additional cutting process is not needed, leading to a reduction in construction period.

Roof Construction Step

Once the wall 200 is installed on the steel floor 100, prefabricated roof frames 300 are placed on the wall 200 using a crane or the like. Then, the steel structure frames 210 of the structural composite light-weight panels 270 of the wall and the roof frames 300 are joined to one another by welding or joining means like a bolt or the like. The steel roof frame 300 composed of a steel structure includes a truss structure to be formed in a roof shape. Also, the steel roof frame 300 may further include a ring-like fixing member such as, for example, an eye bolt mounted on the top thereof so that the roof frame 300 can be lifted by the crane. Alternatively, the roof frame 300 may be installed on the steel structure frames 210 by hooking the crane onto a truss or a ridge constituting the roof frame 300

Finishing Step

In this manner, once the roof frames 300 and the wall 200 are constructed, wall interior and exterior coverings 410 are applied to the inner and outer peripheries of the wall 200, and the roof frames 300 are covered by a roof covering 420 (for example, an asphalt single or the like) such as a sandwich panel or the like to finish the roof.

Figure 3:
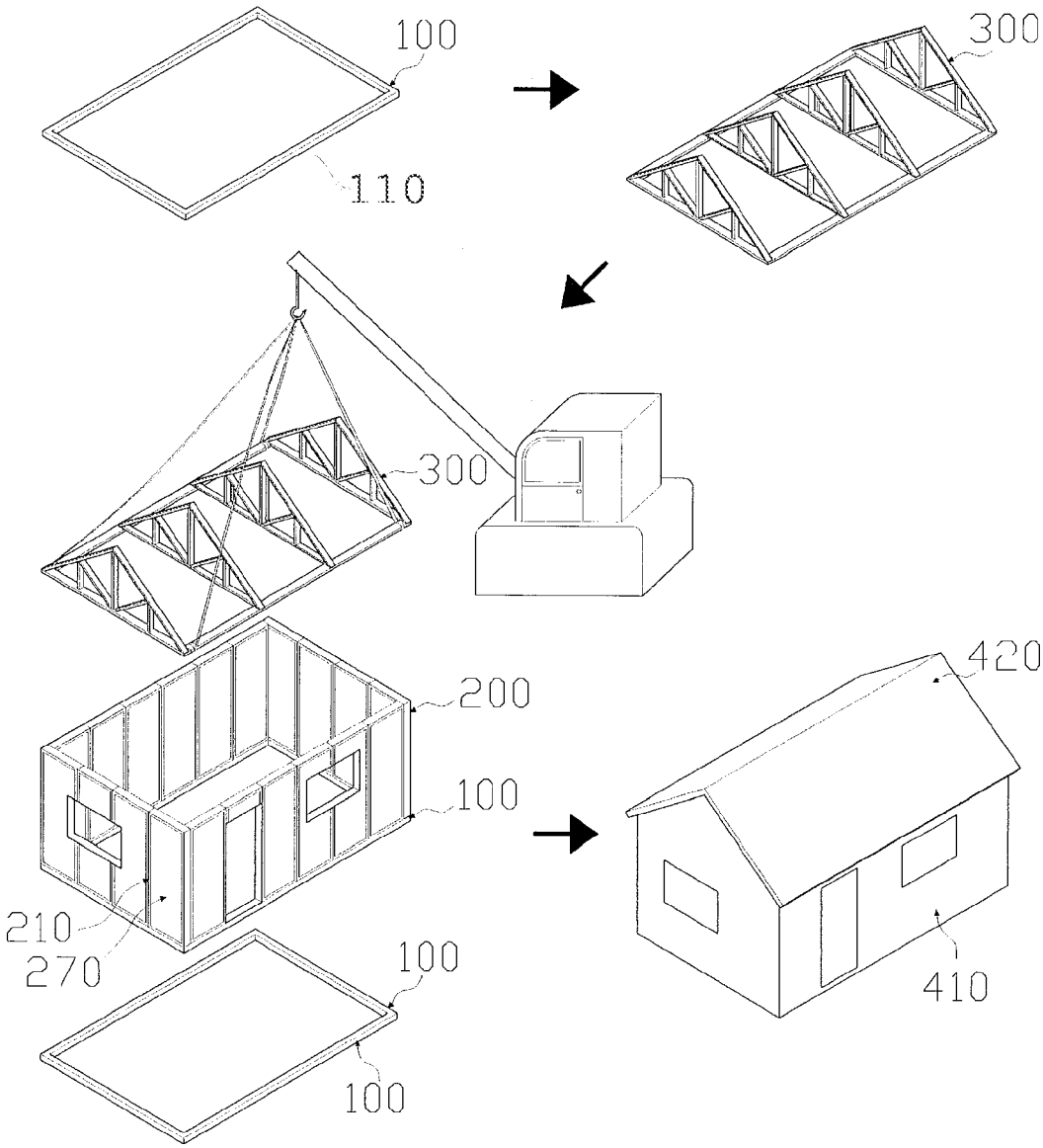
FIGS. 3 and 4 are process perspective views showing other examples of the constitution and construction process of a building using structural composite light-weight panels according to the present invention.

In addition, in another example of the building construction method, as shown in FIG. 3, after the foundation work execution step and the steel floor construction step are performed, a roof frame formation step is performed in which the roof frames are formed on the steel floor to conform to the dimension of the steel floor. The reason for this is that if the roof frames are formed on the steel floor, the dimension of the roof frames can be correctly identical to that of the steel floor and the roof frames can be maintained correctly at horizontal and vertical positions.

The thus formed roof frames are removed upwardly from the steel floor by a crane or the like. Then, the structural composite light-weight panels are joined to corner portions of the steel floor and reinforcing positions for supporting the roof frames by welding or joining means to form a wall structure.

Thereafter, the roof frames are joined to the top of the wall structure, and other structural composite light-weight panels are installed between the structural composite light-weight panels installed in the wall structure forming step to construct the wall.

Then, the inner and outer peripheries of the wall and a roof face are covered by wall and roof converings to complete the construction of a building.

Figure 4:
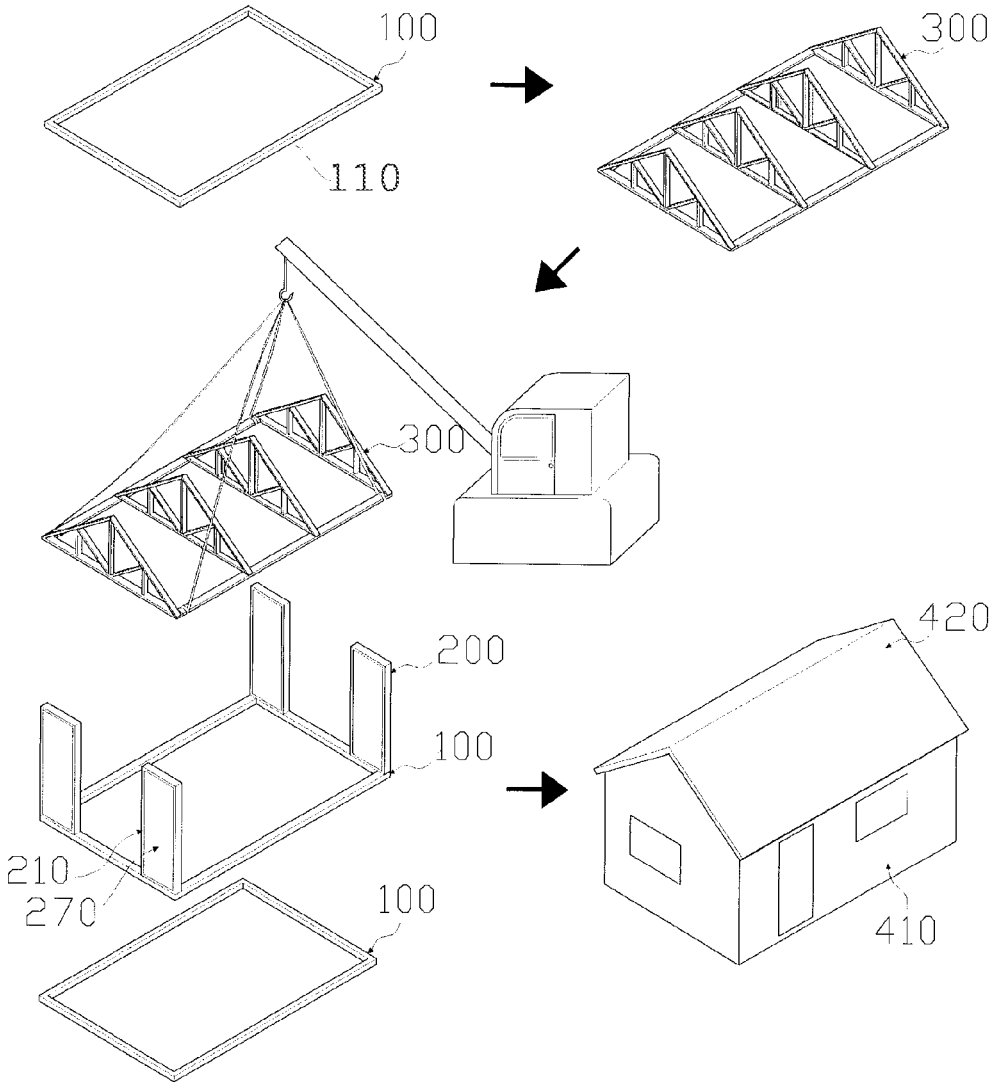

Further, in yet another example of the building construction method using the structural composite light-weight panels, as shown in FIG. 4, after the foundation work execution step, the steel floor construction step and the roof frame formation step are performed, the roof frames are removed from the steel floor. Then, the following steps are sequentially performed: a wall construction step in which the wall is formed by using the structural composite light-weight panels according to any one of claims 3 to 7 of the appended claims to form the wall and the wall is joined to the steel floor by welding or joining means, a roof construction step in which the roof frames are joined to the top of the wall by welding or joining means, and a finishing step in which the inner and outer peripheries of the wall and the roof face are covered by wall and roof coverings to complete the construction of a building.

In the meantime, in the above embodiments, the wall construction step may include directly joining the structural composite light-weight panels to the steel floor by the welding or joining means on-site, or may include joining the structural composite light-weight panels in a predetermined size (for example, size of one-side wall face, size of a partition dimension, or truck-movable dimension) by the welding or joining means in a factory to form a unit body and then the unit bodies are joined to each other on-site, leading to a reduction in construction period.

Besides, in the above embodiments, although the roof frames 300 are installed on the wall 200 in a state of being not applied with a roof covering 420, the roof frames 300 may be installed on the wall 200 after being lifted by the crane in a state in which the roof covering 420 is applied to the roof frames 300 or a worker may install the roof frames 300 on the wall 200 personally in a state in which the worker goes up to the top of the wall 200.

Embodiments of the structural composite light-weight panel as constructed above will be described hereinafter with reference to FIGS. 5 to 12.

Figure 5:
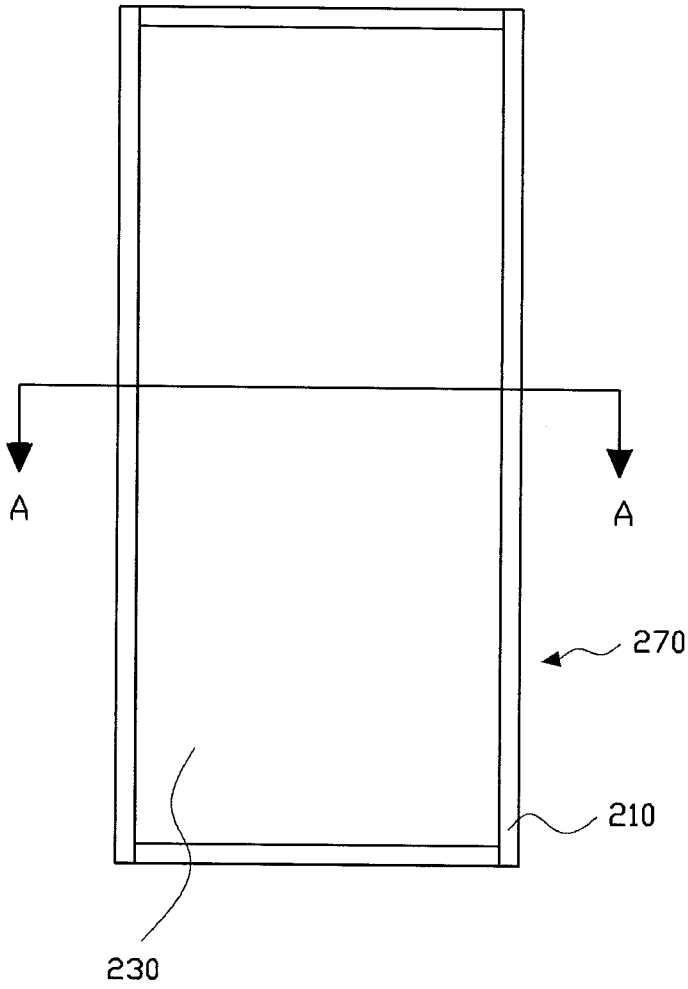
FIG. 5 is a front elevational view showing a first embodiment of a structural composite light-weight panel according to the present invention.
Figure 6:
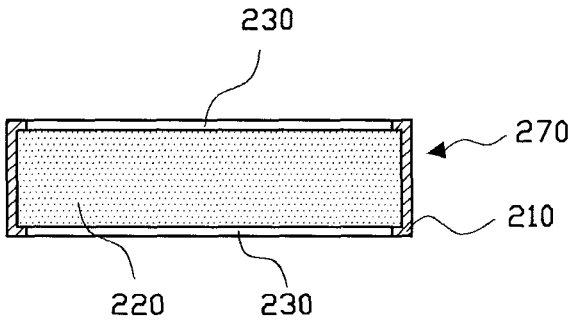
FIG. 6 is a cross-sectional view taken along the line A-A of FIG. 5.

First, a first embodiment of the structural composite light-weight panel 270 will be described hereinafter with reference to FIGS. 5 and 6.

The structural composite light-weight panel 270 includes rectangular steel structure frames 210, a heat insulating material 220 disposed within the steel structure frames 210, and interior and exterior covering structures 230 disposed at both sides of the heat insulating material 220.

In the above constitution, the heat insulating material 220 employs a typical polystyrene foam (Styrofoam) or the like, and the interior and exterior covering structures 230 may employ any material to which joining means (bolt, piece or the like) for covering a covering material such as plywood, recyclable plywood, wood, waste wood, plastic or the like can be fixed.

Figure 7:
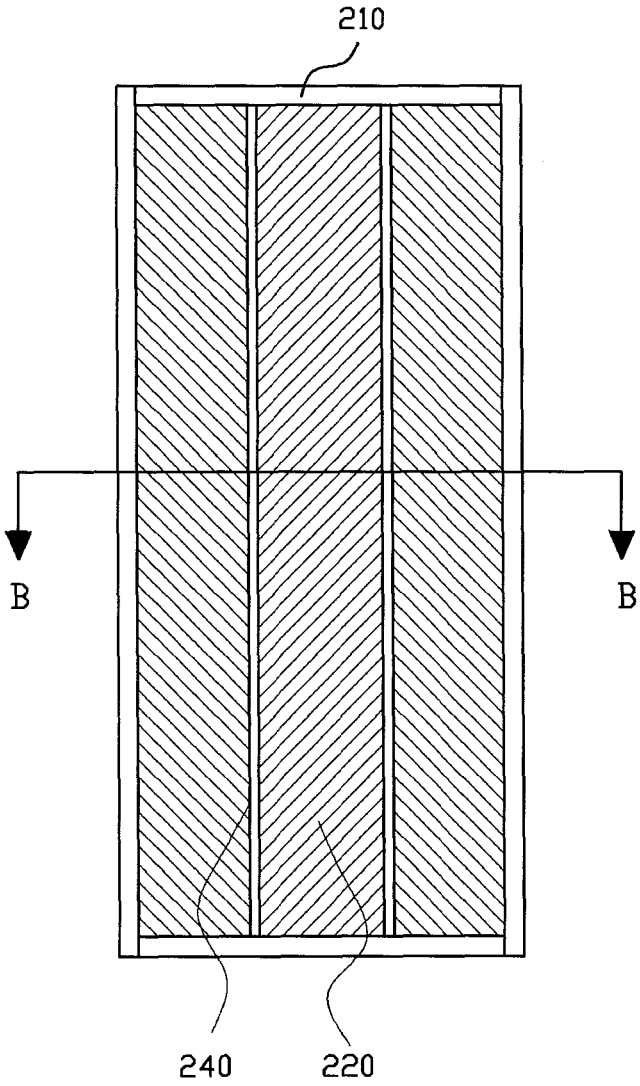
FIG. 7 is a longitudinal cross-sectional view showing a second embodiment of a structural composite light-weight panel.
Figure 8:
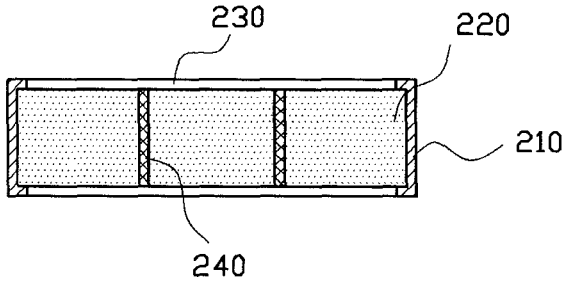
FIG. 8 is a cross-sectional view taken along the line B-B of FIG. 7.

In addition, a second embodiment of the structural composite light-weight panel 270 will be described hereinafter with reference to FIGS. 7 and 8.

The structural composite light-weight panel 270 includes rectangular steel structure frames 210, a plurality of structural boards 240 arranged vertically within the steel structure frames 210, a heat insulating material 220 disposed between the structural boards 240, and interior and exterior covering structures 230 disposed at both sides of the heat insulating material 220.

In the above constitution, the heat insulating material 220 employs a typical polystyrene foam (Styrofoam) or the like.

Figure 9:
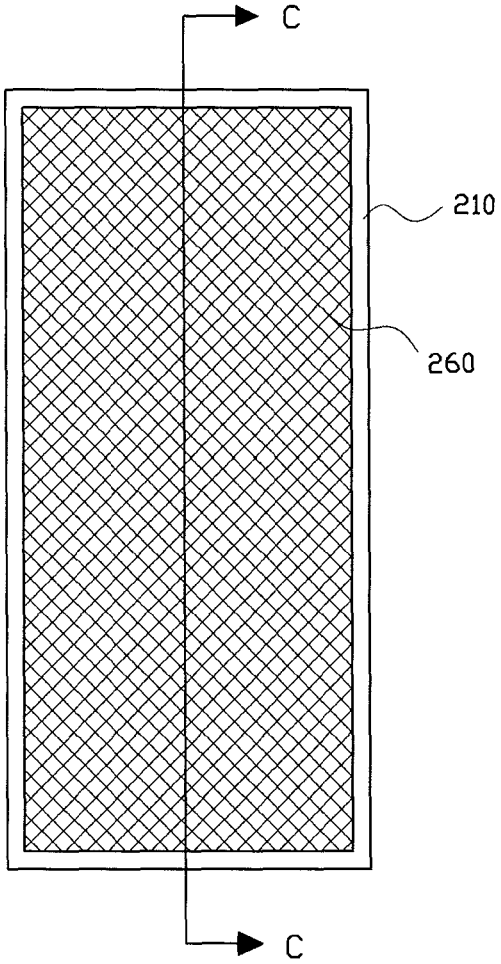
FIG. 9 is a front elevational view showing a third embodiment of a structural composite light-weight panel according to the present invention.
Figure 10:
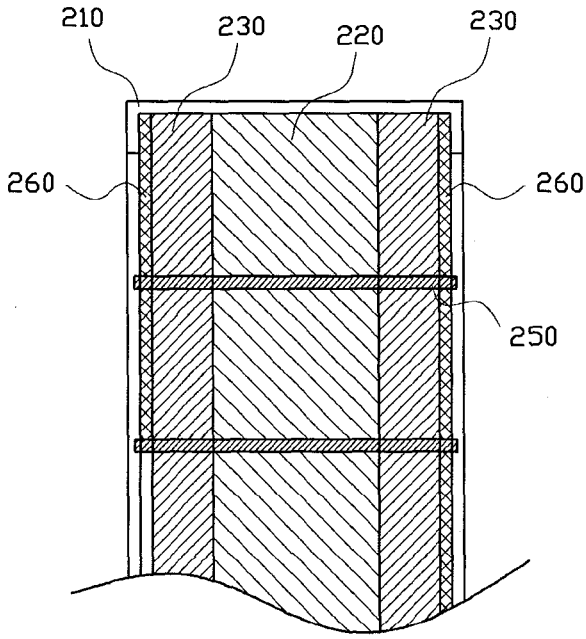
FIG. 10 is a cross-sectional view taken along the line C-C of FIG. 9.

Now, a third embodiment of the structural composite light-weight panel 270 will be described hereinafter with reference to FIGS. 9 and 10.

The structural composite light-weight panel 270 includes rectangular steel structure frames 210, a heat insulating material 220 disposed within the steel structure frames 210, a pair of opposed meshes 260 installed to both sides of the heat insulating material 220 by means of pins 250 in such a fashion as to be spaced apart from each other by a predetermined distance, and interior and exterior covering structures 230 disposed between the heat insulating material 220 and the meshes 260 and made of a material capable of fixing interior and exterior coverings.

In the above constitution, the steel structure frames 210 may be installed in such a fashion as to be interposed between the meshes 260 and the inter and external coverings, and may be installed so as to be positioned at the outside of the meshes 260.

Figure 11:
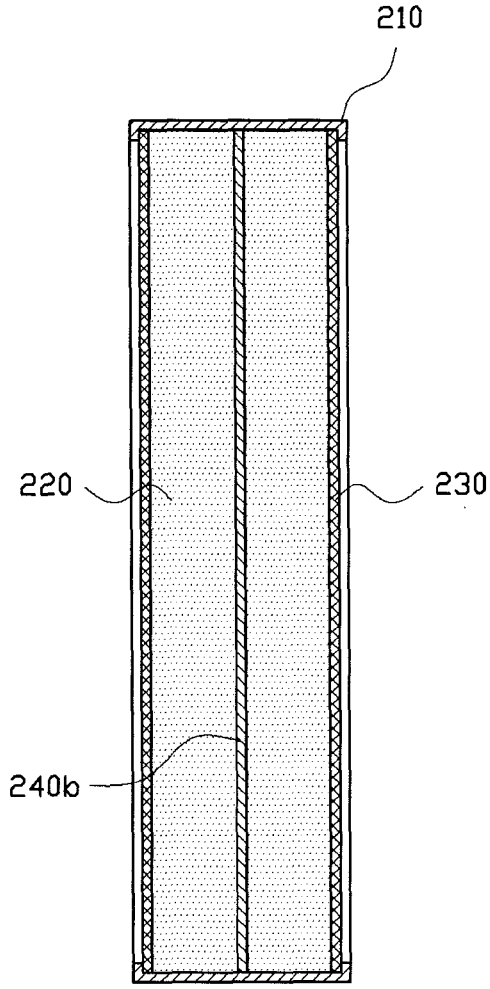
FIG. 11 is a crossed-sectional view showing a fourth embodiment of a structural composite light-weight panel.

Also, a fourth embodiment of the structural composite light-weight panel 270 will be described hereinafter with reference to FIG. 11.

The structural composite light-weight panel 270 includes rectangular steel structure frames 210, a structural board 240 arranged vertically within the steel structure frames 210, a heat insulating material 220 disposed between the structural boards 240, and interior and exterior covering structures 230 disposed at both sides of the heat insulating material 220 so as to be oriented in parallel with the structural board 240.

In the above constitution, the heat insulating material 220 employs a typical polystyrene foam (Styrofoam) or the like.

A fourth embodiment of the structural composite light-weight panel 270 will be described hereinafter with reference to FIG. 12.

Figure 12:
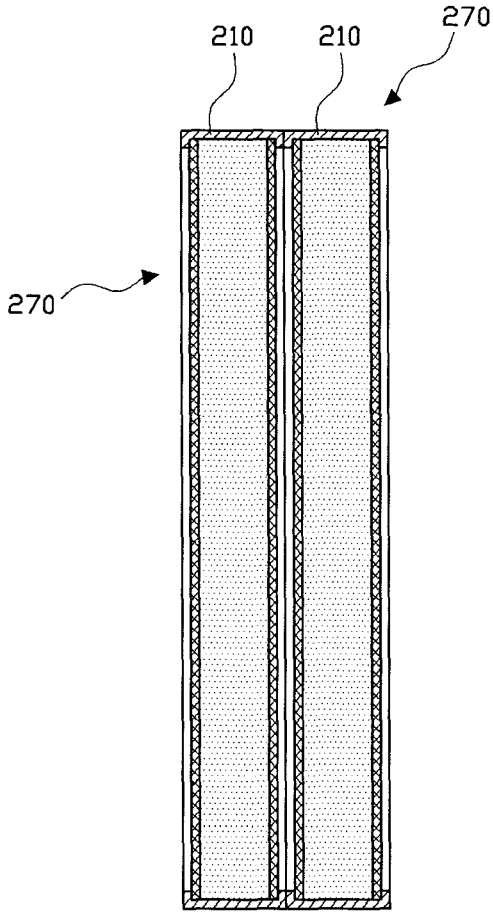
FIG. 12 is a crossed-sectional view showing a fifth embodiment of a structural composite light-weight panel.

As shown in FIG. 12, the structural composite light-weight panels 270 is superposedly disposed in plural numbers in a juxtaposition relationship such that the steel structure frames 210 abutting against each other are joined to each other by welding or joining means.

In the meantime, in the process of fabricating the structural composite light-weight panel, the structural composite light-weight panel may include an electric bellows, hot/cold water pipings or the like embedded therein. As an example, in case of the structural composite light-weight panel according to a fifth embodiment of the present invention, the electric bellows, the hot/cold water pipings or the like may be embedded in a space defined by joining the mutually abutting steel structure frames 210 to each other. Alternatively, in case of other structural composite light-weight panels, the electric bellows, the hot/cold water pipings or the like may be embedded in the heat insulating material.

The constitution of the rectangular steel structure frame 210 will be described hereinafter with reference to FIGS. 13 to 15.

Figure 13:
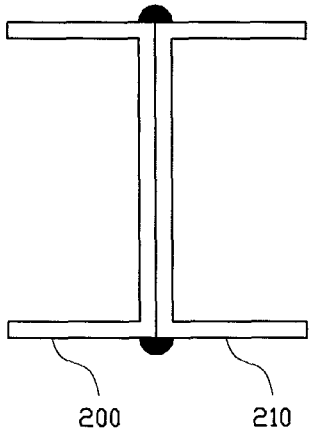
FIGS. 13 to 15 are cross-sectional views showing the constitution of a steel structure frame.
Figure 14:
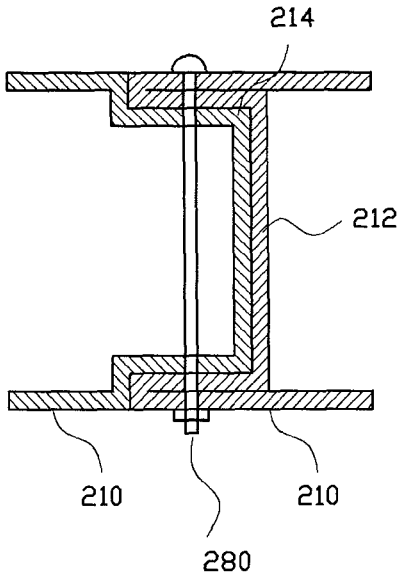
Figure 15:
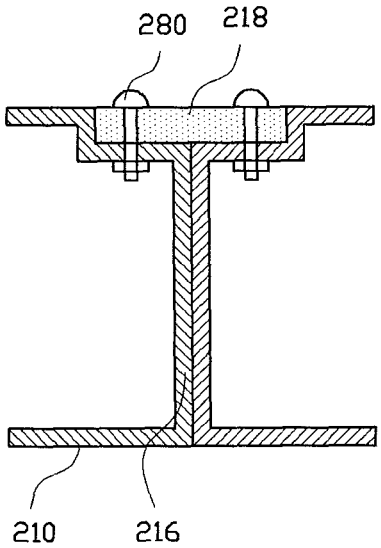

Neighboring steel structure frames 210 may be joined to each other by welding in a state in which the confronting surfaces thereof abut against each other using a section steel having a "ㄷ" shape in cross-section as shown in FIG. 13, neighboring steel structure frames 210 may include a concave portion 212 and convex portion 214 formed correspondingly therein so as to be engaged with each other in a concave and convex engagement relationship such that they are joined to each other by welding or joining means as shown in FIG. 14, or neighboring steel structure frames 210 may be joined to each other by welding or joining means 280 in a state in which longitudinal end faces thereof are partially protruded correspondingly so that the partially protruded longitudinal end faces are positioned abutting against each other, and an additional reinforcing panel 218 is attached to one sides of the convex portions 216 as shown in FIG. 15.

In addition, in the above constitution, wall interior and exterior coverings applied to the inner and outer peripheries of the structural composite light-weight panels of the wall may include plaster board, Hwang Toh (red clay) mortar, plaster mortar, sprayed-on fireproofing material or the like so as to be applied to one side or both sides of the structural composite light-weight panel, and another covering such as wallpaper or waterproofing sheet may be applied thereon.

The invention claimed is:

1. A building with a plurality of a first and a second structural composite light-weight panels, the building comprising:

a steel floor made of section steel;

a wall including the plurality of the first and the second structural composite light-weight panels, each of the first and the second structural composite light-weight panel having steel structure frames installed at edges thereof;

heat insulating material disposed within the steel structure frames; and interior and exterior covering structures disposed respectively at both sides of the heat insulating material and made of a material capable of fixing the interior and exterior coverings, wherein the first and the second structural composite light-weight panels are joined to the steel floor by welding or a first joining member, and the first and the second steel structure frames of the panels are joined together by welding or a second joining member to form the wall;

a roof including a roof frame composed of a steel structure and a truss structure, the roof frame being positioned on a top of the wall so as to be joined to the plurality of the first and the second structural composite light-weight panels of the wall by welding or a third joining member;

wall interior and exterior coverings applied respectively to the inner and outer peripheries of the wall; and a roof covering disposed on an outer periphery of the roof.

2. The building with the plurality of the first and the second structural composite light-weight panels according to claim 1, wherein the first and the second steel structure frames are installed by any one selected from the following joining methods:

a method in which the steel structure frames of the first and second structural composite light-weight panels are coupled to each other by welding in which the confronting surfaces thereof abut against each other with a section steel having a ⊏ shape in cross-section, a method in which steel structure frames of the first and second structural composite light-weight panels include a concave portion and a convex portion configured correspondingly therein so as to be engaged with each other in a concave and convex engagement relationship such that they are coupled to each other by welding or a coupling member, or a method in which the steel structure frames of the first and second structural composite light-weight panels are joined to each other by welding or a coupling member in which at least a pair of longitudinal ends of the steel structure frames are bent so that the pair of the longitudinal ends is configured to receive an additional reinforcing panel.

3. The building with the plurality of the first and the second structural composite light-weight panels according to claim 1, wherein the steel structure frames of at least one of the first and second structural composite light-weight panels are rectangular shaped in a cross-section.

4. The building with the plurality of the first and the second structural composite light-weight panels according to claim 1, wherein the second structural composite light-weight panel further comprises of structural boards arranged vertically within the steel structure frames.

5. The building with the plurality of the first and the second structural composite light-weight panels according to claim 1, wherein the second structural composite light-weight panel further comprises, a pair of opposed meshes installed to both sides of the heat insulating material by pins in such a fashion as to be spaced apart from each other by a predetermined distance, and interior and exterior covering structures disposed between the heat insulating material and the meshes and made of a material capable of fixing interior and exterior coverings.

6. The building with the plurality of the first and the second structural composite light-weight panels according to claim 1, wherein the plurality of the first and the second structural composite light-weight panels are disposed in a stack in a parallel direction to each other, and wherein the steel structure frames abutting against each other are joined to each other by welding or a coupling member.

7. A method of constructing a building using a plurality of a first and a second structural composite light-weight panels, the method comprising, in the following order, the steps of:

executing a foundation work;

providing a steel floor in which a floor shape of the building is formed on a ground using a steel frame made of a section steel to form the steel floor;

constructing a roof frame in which the roof frame is formed on the steel floor so that a size of the roof frame is configured to correspond to a size of the steel floor;

lifting the roof frame by a lifting machine separately from the steel floor;

constructing a part of a wall in which the first structural composite light-weight panel includes a heat insulating material, interior and exterior covering structures, and steel structure frames installed at edges thereof, and wherein the first structural composite light-weight panel is joined to the steel floor by welding or a first coupling member to form the part of the wall on the steel floor;

joining the roof frame in which the roof frame is joined on the top of the wall by welding or a second coupling member;

constructing the rest part of the wall in which the second structural composite light-weight panels are installed between a pair of the first structural composite light-weight panels to construct the rest part of the wall; and finishing constructing the building in which inner and outer peripheries of the wall and the roof frame are covered by the wall and roof coverings to complete the construction of the building.

8. A method of constructing a building using a plurality of structural composite light-weight panels, the method comprising, in the following order, the steps of:

executing a foundation work;

providing a steel floor in which a floor shape of the building is formed on a ground using a steel frame made of a section steel to form a steel floor;

constructing a roof frame in which the roof frame is formed on the steel floor so that a size of the roof frame is configured to correspond to a size of the steel floor;

lifting the roof frame by a lifting machine separately from the steel floor;

constructing a wall in which the wall is formed by using the plurality of structural composite light-weight panels and are joined to the steel floor by welding or a first coupling member;

joining the roof frame in which the roof frame is joined on the top of the wall by welding or a second coupling member; and finishing constructing the building in which inner and outer peripheries of the wall and the roof frame are covered by the wall and roof coverings to complete the construction of the building.

9. The method according to claim 7, wherein the roof covering in the finishing step is performed in the roof frame construction step.

10. The method according to claim 7, wherein, in the wall construction step, the wall is configured to join to the steel floor, or is configured to have a plurality of unit bodies of a predetermined size by a manufacturer and the plurality of the unit bodies are configured to join each other.

11. The method according to claim 8, wherein the roof covering in the finishing step is performed in the roof frame construction step.

12. The method according to claim 8, wherein, in the wall construction step, the wall is directly configured to join to the steel floor, or is configured to have a plurality of unit bodies of a predetermined size by a manufacturer and the plurality of the unit bodies are configured to join each other.

13. The building with the plurality of the first and the second structural composite light-weight panels according to claim 1, wherein the plurality of a pair of the first structural composite light-weight panel and a pair of the second structural composite light-weight panel are disposed in a stack in a parallel direction to each other, and wherein the steel structure frames of the first and second structural composite light-weight panels abutting against each other are joined to each other by welding or a coupling member.

14. The building with the plurality of structural composite light-weight panels according to claim 13, wherein an embedded hot/cold pipe is located in a space defined by joining the first and the second steel structure frames mutually abutting to each other.

15. The method according to claim 7, wherein the second steel structure frame further comprises:

second steel structure frames installed at edges thereof;

a second heat insulating material disposed within the second steel structure frames;

second interior and exterior covering structures disposed respectively at both sides of the second heat insulating material and made of a material capable of fixing the second interior and exterior coverings; and a plurality of structural boards arranged vertically within the steel structure frames, wherein the second heat insulating material is disposed between the structural boards, and the second interior and exterior covering structures are disposed respectively at both sides of the heat insulating material.

* * * * *